US009695683B2

(12) United States Patent
Kumar et al.

(10) Patent No.: US 9,695,683 B2
(45) Date of Patent: Jul. 4, 2017

(54) PDC SENSING ELEMENT FABRICATION PROCESS AND TOOL

(71) Applicant: Baker Hughes Incorporated, Houston, TX (US)

(72) Inventors: Sunil Kumar, Celle (DE); Anthony A. DiGiovanni, Houston, TX (US); Danny E. Scott, Montgomery, TX (US); Hendrik John, Celle (DE); Othon Monteiro, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 338 days.

(21) Appl. No.: 14/252,484

(22) Filed: Apr. 14, 2014

(65) Prior Publication Data

US 2014/0224539 A1 Aug. 14, 2014

Related U.S. Application Data

(62) Division of application No. 13/093,326, filed on Apr. 25, 2011, now Pat. No. 8,695,729.

(60) Provisional application No. 61/408,119, filed on Oct. 29, 2010, provisional application No. 61/408,106, filed on Oct. 29, 2010, provisional application No. 61/408,144, filed on Oct. 29, 2010, provisional application No. 61/328,782, filed on Apr. 28, 2010.

(51) Int. Cl.

| | |
|---|---|
| ***E21B 47/00*** | (2012.01) |
| ***E21B 10/08*** | (2006.01) |
| ***E21B 10/56*** | (2006.01) |
| ***E21B 10/567*** | (2006.01) |

(52) U.S. Cl.
CPC ..... *E21B 47/00* (2013.01); *E21B 10/08* (2013.01); *E21B 10/567* (2013.01); *Y10T 29/49002* (2015.01)

(58) Field of Classification Search
CPC ..... E21B 10/08; E21B 10/42; E21B 47/00
See application file for complete search history.

(56) References Cited

U.S. PATENT DOCUMENTS

| | | | |
|---|---|---|---|
| 4,645,977 | A | 2/1987 | Kurokawa et al. |
| 4,707,384 | A | 11/1987 | Schachner et al. |
| 4,785,894 | A | 11/1988 | Davis et al. |
| 4,785,895 | A | 11/1988 | Davis et al. |

(Continued)

FOREIGN PATENT DOCUMENTS

| | | | | |
|---|---|---|---|---|
| BE | WO 2010001277 A1 * | 1/2010 | ..... | G01N 27/227 |
| CN | 2791245 Y | 3/2006 | | |

(Continued)

OTHER PUBLICATIONS

Battaglia et al., Estimation of Heat Fluxes During High-Speed Drilling, Int. Jnl. Adv. Manf. Technol., vol. 26, pp. 750-758 (2008).

(Continued)

*Primary Examiner* — Jennifer H Gay
(74) *Attorney, Agent, or Firm* — TraskBritt

(57) ABSTRACT

A Polycrystalline Diamond Compact (PDC) cutter for a rotary drill bit is provided with an integrated sensor and circuitry for making measurements of a property of a fluid in the borehole and/or an operating condition of the drill bit. A method of manufacture of the PDC cutter and the rotary drill bit is discussed.

17 Claims, 13 Drawing Sheets

(56) References Cited

U.S. PATENT DOCUMENTS 4,849,945 A 7/1989 Widrow
4,862,423 A 8/1989 Rector et al.
4,926,391 A 5/1990 Rector et al.
4,927,300 A * 5/1990 Ramalingam ..... B23Q 17/0957 407/120
4,954,998 A 9/1990 Rector et al.
4,964,087 A 10/1990 Widrow
4,965,774 A 10/1990 Ng et al.
4,976,324 A 12/1990 Tibbitts
5,012,453 A 4/1991 Katz
5,066,938 A 11/1991 Kobashi et al.
5,109,947 A 5/1992 Rector et al.
5,144,591 A 9/1992 Hardage
5,176,053 A * 1/1993 Alvelid ..... B23B 27/145 374/141
5,317,302 A 5/1994 Yamazaki et al.
5,337,844 A 8/1994 Tibbitts
5,372,207 A 12/1994 Naville et al.
5,438,860 A 8/1995 Kawai et al.
5,467,320 A 11/1995 Maki
5,511,038 A 4/1996 Angeleri et al.
5,512,873 A 4/1996 Saito et al.
5,523,121 A 6/1996 Anthony et al.
5,585,556 A 12/1996 Petersen et al.
5,706,906 A 1/1998 Jurewicz et al.
5,881,830 A 3/1999 Cooley
5,924,499 A 7/1999 Birchak et al.
6,068,070 A 5/2000 Scott
6,078,868 A 6/2000 Dubinsky et al.
6,151,554 A 11/2000 Rodney et al.
6,193,001 B1 2/2001 Eyre et al.
6,262,941 B1 7/2001 Naville
6,274,403 B1 8/2001 Klages et al.
6,315,062 B1 11/2001 Alft et al.
6,540,033 B1 4/2003 Sullivan et al.
6,564,883 B2 5/2003 Fredericks et al.
6,571,886 B1 6/2003 Sullivan et al.
6,626,251 B1 9/2003 Sullivan et al.
6,892,836 B1 5/2005 Eyre et al.
7,052,215 B2 5/2006 Fukano
7,066,280 B2 6/2006 Sullivan et al.
7,168,506 B2 1/2007 Boucher et al.
7,301,223 B2 11/2007 Rodney et al.
7,338,202 B1 3/2008 Kapat et al.
7,350,568 B2 4/2008 Mandal et al.
7,398,837 B2 7/2008 Hall et al.
7,451,838 B2 11/2008 Keshavan
7,697,375 B2 4/2010 Reiderman et al.
7,730,967 B2 6/2010 Ballantyne et al.
7,946,357 B2 5/2011 Trinh et al.
8,122,980 B2 2/2012 Hall et al.
8,210,280 B2 7/2012 Trinh et al.
8,215,384 B2 7/2012 Trinh et al.
8,250,786 B2 8/2012 Hall et al.
8,316,964 B2 11/2012 Hall et al.
8,695,729 B2 * 4/2014 Kumar ..... E21B 10/08 175/39
2001/0054514 A1 12/2001 Sullivan et al.
2003/0146675 A1 * 8/2003 Cuhat ..... H01L 41/047 310/319
2003/0192721 A1 10/2003 Singh et al.
2004/0011567 A1 1/2004 Singh et al.
2004/0069539 A1 4/2004 Sullivan et al.
2004/0222018 A1 11/2004 Sullivan et al.
2004/0240320 A1 12/2004 McDonald et al.
2005/0067191 A1 3/2005 Miyamoto
2005/0230149 A1 10/2005 Boucher et al.
2005/0279532 A1 12/2005 Ballantyne et al.
2006/0018360 A1 1/2006 Tai et al.
2006/0065395 A1 3/2006 Snell
2006/0070770 A1 * 4/2006 Marsh ..... E21B 44/00 175/27
2006/0175057 A1 8/2006 Mandal
2007/0029116 A1 2/2007 Keshavan
2007/0056171 A1 3/2007 Taryoto
2007/0107938 A1 5/2007 Cornish et al.
2007/0114061 A1 5/2007 Hall et al.
2007/0114062 A1 5/2007 Hall et al.
2007/0148416 A1 * 6/2007 Wolkin ..... G01K 17/006 428/195.1
2007/0186639 A1 8/2007 Spross et al.
2007/0263488 A1 11/2007 Clark
2007/0272442 A1 * 11/2007 Pastusek ..... E21B 21/08 175/40
2007/0272552 A1 * 11/2007 Jiang ..... E21B 47/10 204/422
2008/0060848 A1 * 3/2008 Pastusek ..... E21B 21/08 175/40
2009/0057033 A1 3/2009 Keshavan
2009/0114628 A1 5/2009 DiGiovanni
2010/0024436 A1 * 2/2010 DiFoggio ..... E21B 47/011 62/3.2
2010/0038136 A1 2/2010 Trinh et al.
2010/0089645 A1 4/2010 Trinh et al.
2010/0101861 A1 4/2010 Chang
2010/0118657 A1 5/2010 Trinh et al.
2010/0155142 A1 6/2010 Thambynayagam et al.
2010/0259127 A1 * 10/2010 Zaitsu ..... B06B 1/0292 310/300
2010/0307835 A1 12/2010 Glasgow et al.
2010/0315901 A1 12/2010 Coman et al.
2010/0319994 A1 12/2010 Wiercigroch
2010/0322020 A1 12/2010 Kim
2010/0326731 A1 12/2010 Swietlik et al.
2011/0100810 A1 * 5/2011 Merz ..... G01N 27/227 204/406
2011/0139507 A1 6/2011 Krueger et al.
2011/0168446 A1 7/2011 Lemenager et al.
2011/0253448 A1 10/2011 Trinh et al.
2011/0266054 A1 11/2011 Kumar et al.
2011/0266055 A1 11/2011 DiGiovanni et al.
2011/0266058 A1 11/2011 Kumar et al.
2012/0000707 A1 1/2012 Hall et al.
2012/0024600 A1 2/2012 Bittar et al.
2012/0037423 A1 2/2012 Geerits et al.
2012/0080229 A1 4/2012 Kumar et al.
2012/0103688 A1 5/2012 Coman et al.
2012/0132468 A1 5/2012 Scott et al.
2012/0279783 A1 11/2012 Trinh et al.
2012/0312598 A1 12/2012 Cheng
2012/0312599 A1 12/2012 Trinh et al.
2012/0325564 A1 12/2012 Vaughn et al.
2013/0068525 A1 3/2013 DiGiovanni
2013/0147633 A1 6/2013 Sumrall et al.
2013/0328191 A1 * 12/2013 Meyer ..... H01L 23/3171 257/738
2014/0061729 A1 * 3/2014 Koo ..... G01N 27/4148 257/253
2014/0224539 A1 * 8/2014 Kumar ..... E21B 10/08 175/50
2014/0246235 A1 * 9/2014 Yao ..... E21B 47/01 175/40
2016/0115740 A1 * 4/2016 Chen ..... E21B 10/25 175/40

FOREIGN PATENT DOCUMENTS

CN 101581219 A 11/2009
EP 559286 A1 9/1993
JP 11101091 A 4/1999
JP 2000225511 A 8/2000
WO 2008106022 A1 4/2008
WO 2010027839 A1 3/2010

OTHER PUBLICATIONS

Zhang et al., Design, Fabrication, and Characterization of Metal Embedded Microphotonic Sensors, Jnl. Manuf. Sci. Eng., vol. 130, No. 3, 031104 (2008).

(56) References Cited

OTHER PUBLICATIONS

Cheng et al. Development of Metal Embedded Microsensors by Diffusion Bonding and Testing in Milling Process, Jnl. Manuf. Sci. Eng., vol. 130, No. 6, 061010 (2008).
International Search Report for International Application No. PCT/US2011/033959 dated Oct. 27, 2011, 6 pages.
International Written Opinion for International Application No. PCT/US2011/033959 dated Oct. 27, 2011, 4 pages.
International Preliminary Report on Patentability for International Application No. PCT/US2011/033959 dated Oct. 30, 2012, 5 pages.
Chinese Office Action and Search Report for Chinese Application No. 201180026350 dated Apr. 2, 2014, 18 pages.
Homstvedt et al., PDC—Bit Evaluation by Cutter Instrumentation and Computer Simulation, SPE 1989, abstract, 2 pages.
European Search Report for European Application No. 11777913.2 dated Oct. 11, 2013, 4 pages.
Canadian Office Action from Canadian Application No. 2,848,298, dated May 28, 2015, 3 pages.
Canadian Second Office Action from Canadian Application No. 2,848,298, dated Mar. 20, 2016, 3 pages.
Canadian Office Action from Canadian Application No. 2,797,673, dated Oct. 3, 2013, 3 pages.
Canadian Second Office Action from Canadian Application No. 2,797,673, dated Jul. 10, 2014, 2 pages.
Chinese Second Office Action for Chinese Application No. 201180026350 dated Sep. 17, 2014, 8 pages.
Chinese Third Office Action for Chinese Application No. 201180026350 dated Apr. 24, 2015, 7 pages.

* cited by examiner

PDC SENSING ELEMENT FABRICATION PROCESS AND TOOL

CROSS-REFERENCE TO RELATED APPLICATIONS

This application is a divisional of U.S. patent application Ser. No. 13/093,326, filed Apr. 25, 2011, now U.S. Pat. No. 8,695,729 issued Apr. 15, 2014, which claims priority from U.S. Provisional Patent Application Ser. No. 61/408,119, filed on Oct. 29, 2010; U.S. Provisional Patent Application Ser. No. 61/408,106, filed on Oct. 29, 2010; U.S. Provisional Patent Application Ser. No. 61/408,144, filed on Oct. 29, 2010; and U.S. Provisional Patent Application Ser. No. 61/328,782, filed on Apr. 28, 2010. The disclosure of U.S. patent application Ser. No. 13/093,326 is hereby incorporated herein in its entirety by this reference.

BACKGROUND OF THE DISCLOSURE

1. Field of the Disclosure

This disclosure relates in general to Polycrystalline Diamond Compact drill bits, and in particular, to a method of and an apparatus for PDC bits with integrated sensors and methods for making such PDC bits.

2. The Related Art

Rotary drill bits are commonly used for drilling boreholes, or well bores, in earth formations. Rotary drill bits include two primary configurations and combinations thereof. One configuration is the roller cone bit, which typically includes three roller cones mounted on support legs that extend from a bit body. Each roller cone is configured to spin or rotate on a support leg. Teeth are provided on the outer surfaces of each roller cone for cutting rock and other earth formations.

A second primary configuration of a rotary drill bit is the fixed-cutter bit (often referred to as a "drag" bit), which conventionally includes a plurality of cutting elements secured to a face region of a bit body. Generally, the cutting elements of a fixed-cutter type drill bit have either a disk shape or a substantially cylindrical shape. A hard, superabrasive material, such as mutually bonded particles of polycrystalline diamond, may be provided on a substantially circular end surface of each cutting element to provide a cutting surface. Such cutting elements are often referred to as "polycrystalline diamond compact" (PDC) cutters. The cutting elements may be fabricated separately from the bit body and are secured within pockets formed in the outer surface of the bit body. A bonding material such as an adhesive or a braze alloy may be used to secure the cutting elements to the bit body. The fixed-cutter drill bit may be placed in a borehole such that the cutting elements abut against the earth formation to be drilled. As the drill bit is rotated, the cutting elements engage and shear away the surface of the underlying formation.

During drilling operations, it is common practice to use measurement while drilling (MWD) and logging while drilling (LWD) sensors to make measurements of drilling conditions or of formation and/or fluid properties and control the drilling operations using the MWD/LWD measurements. The tools are either housed in a bottom-hole assembly (BHA) or formed so as to be compatible with the drill stem. It is desirable to obtain information from the formation as close to the tip of the drill bit as is feasible.

The present disclosure is directed toward a drill bit having PDC cutting elements including integrated circuits configured to measure drilling conditions, properties of fluids in the borehole, properties of earth formations, and/or properties of fluids in earth formations. By having sensors on the drill bit, the time lag between the bit penetrating the formation and the time the MWD/LWD tool senses formation property or drilling condition is substantially eliminated. In addition, by having sensors at the drill bit, unsafe drilling conditions are more likely to be detected in time to take remedial action. In addition, pristine formation properties can be measured without any contamination or with reduced contamination from drilling fluids. For example, mud cake on the borehole wall prevents and/or distorts rock property measurements such as resistivity, nuclear, and acoustic measurements. Drilling fluid invasion into the formation contaminates the native fluid and gives erroneous results.

SUMMARY OF THE DISCLOSURE

One embodiment of the disclosure is a rotary drill bit configured to be conveyed in a borehole and drill an earth formation. The rotary drill bit includes: at least one polycrystalline diamond compact (PDC) cutter including: (i) at least one cutting element, and (ii) at least one transducer configured to provide a signal indicative of at least one of: (I) an operating condition of the drill bit, and (II) a property of a fluid in the borehole, and (III) a property of the surrounding formation.

Another embodiment of the disclosure is a method of conducting drilling operations. The method includes: conveying a rotary drill bit into a borehole and drilling an earth formation; and using at least one transducer on a polycrystalline diamond compact (PDC) cutter coupled to a body of the rotary drill bit for providing a signal indicative of at least one of: (I) an operating condition of the drill bit, and (II) a property of a fluid in the borehole, and (III) a property of the formation.

Another embodiment of the disclosure is a method of forming a rotary drill bit. The method includes: making at least one polycrystalline diamond compact (PDC) cutter including: (i) at least one cutting element, (ii) at least one transducer configured to provide a signal indicative of at least one of: (I) an operating condition of the drill bit, and (II) a property of a fluid in the borehole, and (III) a property of the formation and (iii) a protective layer on a side of the at least one transducer opposite to the at least one cutting element; and using the protective layer for protecting a sensing layer including the at least one transducer from abrasion.

BRIEF DESCRIPTION OF THE DRAWINGS

For a detailed understanding of the present disclosure, reference should be made to the following detailed description of the disclosure, taken in conjunction with the accompanying drawings.

DETAILED DESCRIPTION OF THE DISCLOSURE

Figure 1:
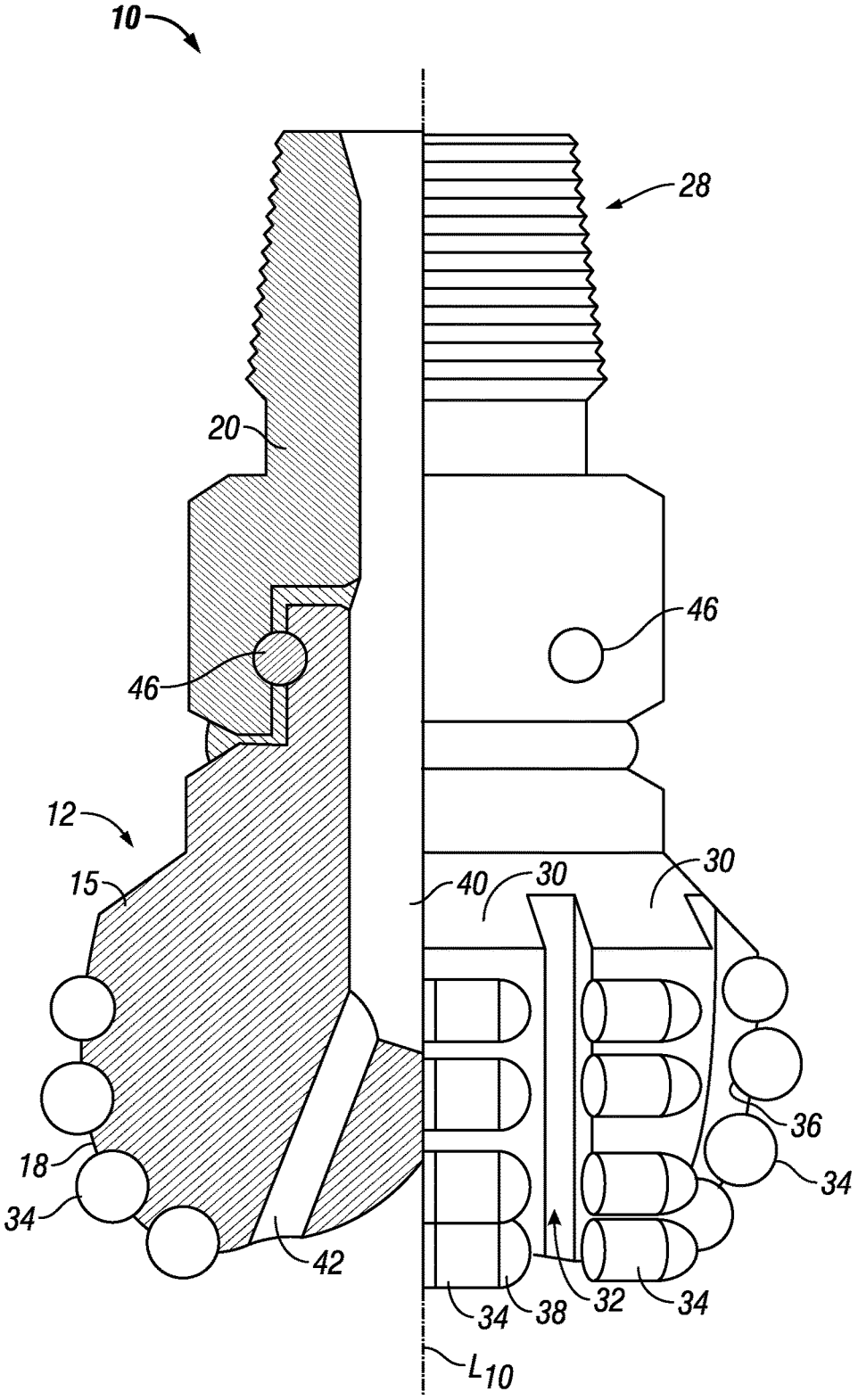
FIG. 1 is a partial cross-sectional side view of an earth-boring rotary drill bit that embodies teachings of the present disclosure and includes a bit body comprising a particle-matrix composite material.

An earth-boring rotary drill bit 10 that embodies teachings of the present disclosure is shown in FIG. 1. The drill bit 10 includes a bit body 12 comprising a particle-matrix composite material 15 that includes a plurality of hard phase particles or regions dispersed throughout a low-melting point binder material. The hard phase particles or regions are "hard" in the sense that they are relatively harder than the surrounding binder material. In some embodiments, the bit body 12 may be predominantly comprised of the particle-matrix composite material 15, which is described in further detail below. The bit body 12 may be fastened to a metal shank 20, which may be formed from steel and may include an American Petroleum Institute (API) threaded pin 28 for attaching the drill bit 10 to a drill string (not shown). The bit body 12 may be secured directly to the shank 20 by, for example, using one or more retaining members 46 in conjunction with brazing and/or welding, as discussed in further detail below.

As shown in FIG. 1, the bit body 12 may include wings or blades 30 that are separated from one another by junk slots 32. Internal fluid passageways 42 may extend between a face 18 of the bit body 12 and a longitudinal bore 40, which extends through the steel shank 20 and at least partially through the bit body 12. In some embodiments, nozzle inserts (not shown) may be provided at the face 18 of the bit body 12 within the internal fluid passageways 42.

The drill bit 10 may include a plurality of cutting elements on the face 18 thereof. By way of example and not limitation, a plurality of polycrystalline diamond compact (PDC) cutters 34 may be provided on each of the blades 30, as shown in FIG. 1. The PDC cutters 34 may be provided along the blades 30 within pockets 36 formed in the face 18 of the bit body 12, and may be supported from behind by buttresses 38, which may be integrally formed with the bit body 12. During drilling operations, the drill bit 10 may be positioned at the bottom of a well bore and rotated while drilling fluid is pumped to the face 18 of the bit body 12 through the longitudinal bore 40 and the internal fluid passageways 42. As the PDC cutters 34 shear or engage the underlying earth formation, the formation cuttings and detritus are mixed with and suspended within the drilling fluid, which passes through the junk slots 32 and the annular space between the well borehole and the drill string to the surface of the earth formation.

Figure 2:
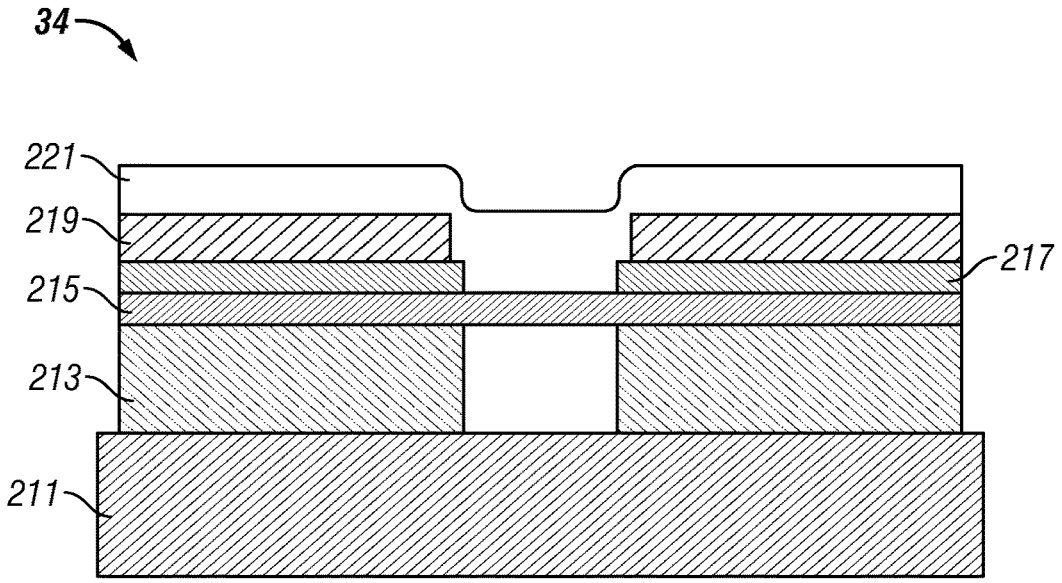
FIG. 2 is an elevational view of a Polycrystalline Diamond Compact portion of a drill bit according to the present disclosure.

Turning now to FIG. 2, a cross section of an exemplary PDC cutter 34 is shown. This includes a PDC cutting element 213. This may also be referred to as part of the diamond table. A thin layer 215 of material such as $Si_3N_4$/$Al_2O_3$ is provided for passivation/adhesion of other elements of the PDC cutter 34 to the cutting elements 213. Chemical-mechanical polishing (CMP) may be used for the upper surface of a passivation layer 215. The cutting element 213 may be provided with a substrate 211.

Layer 217 includes metal traces and patterns for the electrical circuitry associated with a sensor. Above the circuit layer is a layer or plurality of layers 219 that may include a piezoelectric element and a p-n-p transistor. These elements may be set up as a Wheatstone bridge for making measurements. The top layer 221 is a protective (passivation) layer that is conformal. The conformal layer 221 makes it possible to uniformly cover layer 217 and/or layer 219 with a protective layer. The layer 221 may be made of diamond-like carbon (DLC).

The sensing material shown above is a piezoelectric material. The use of the piezoelectric material makes it possible to measure the strain on the cutter 34 during drilling operations. This is not to be construed as a limitation and a variety of sensors may be incorporated into the layer 219. For example, an array of electrical pads to measure the electrical potential of the adjoining formation or to investigate high-frequency (HF) attenuation may be used. Alternatively, an array of ultrasonic transducers for acoustic imaging, acoustic velocity determination, acoustic attenuation determination, and shear wave propagation may be used.

Sensors for other physical properties may be used. These include accelerometers, gyroscopes and inclinometers. Micro-electro-mechanical-system (MEMS) or nano-electro-mechanical-system (NEMS) style sensors and related signal conditioning circuitry can be built directly inside the PDC or on the surface: These are examples of sensors for a physical condition of the cutter and drill stem.

Chemical sensors that can be incorporated include sensors for elemental analysis: carbon nanotube (CNT), complementary metal oxide semiconductor (CMOS) sensors to detect the presence of various trace elements based on the principle of a selectively gated field effect transistor (FET) or ion sensitive field effect transistor (ISFET) for pH, $H_2S$ and other ions; sensors for hydrocarbon analysis; CNT, DLC based sensors working on chemical electropotential; and sensors for carbon/oxygen analysis. These are examples of sensors for analysis of a fluid in the borehole.

Acoustic sensors for acoustic imaging of the rock may be provided. For the purposes of the present disclosure, all of these types of sensors may be referred to as "transducers." The broad dictionary meaning of the term is intended: "a device actuated by power from one system and supplying power in the same or any other form to a second system." This includes sensors that provide an electric signal in response to a measurement such as radiation, as well as a device that uses electric power to produce mechanical motion.

Figure 3:
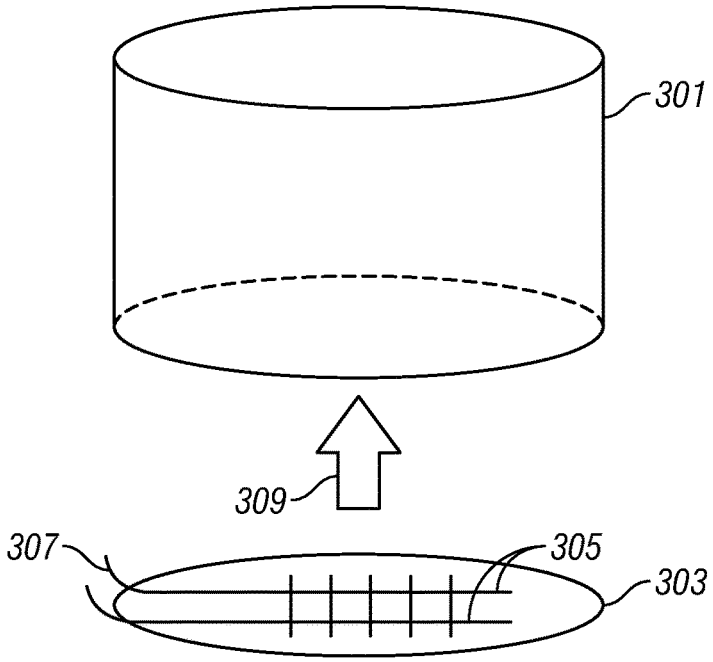
FIG. 3 shows an example of a pad including an array of sensors.

In one embodiment of the disclosure shown in FIG. 3, a sensor pad 303 provided with an array of sensing elements 305 is shown. The sensing elements 305 may include pressure sensors, temperature sensors, stress sensors and/or strain sensors. Using the array of sensing elements 305, it is possible to make measurements of variations of the fence parameter across the face of the PDC element 301. Electrical leads 307 to the array of sensing elements 305 are shown. The pad 303 may be glued onto the PDC element 301 as indicated by arrow 309.

Figure 4:
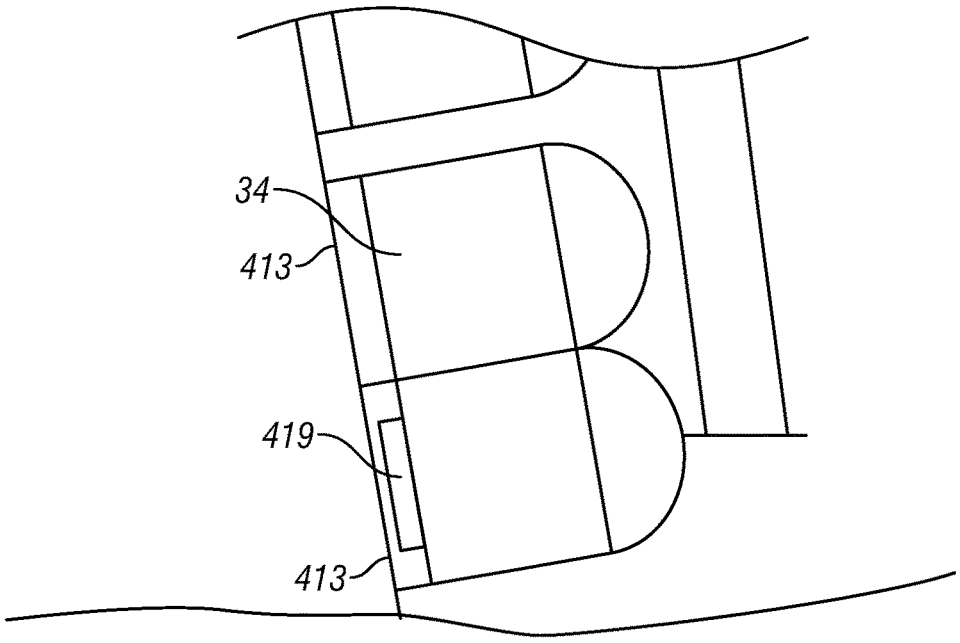
FIG. 4 shows an example of a cutter including a sensor and a PDC cutting element.

In one embodiment of the disclosure shown in FIG. 4, a sensor 419 is shown on the PDC cutter 34. The sensor 419 may be a chemical field effect transistor (FET). A PDC element 413 is provided with grooves to allow fluid and particle flow to the sensor 419. In another embodiment of the disclosure, the sensor 419 may comprise an acoustic transducer configured to measure the acoustic velocity of the fluids and particles in the grooves. The acoustic sensors may be built from thin films or may be made of piezoelectric elements. The sensing layer can be built on top of the diamond table or below the diamond table or on the substrate surface, (either of the interfaces with the diamond table or with the drill bit matrix). In another embodiment of the disclosure, the sensor 419 may include an array of sensors of the type discussed above with reference to FIG. 3.

Figure 5A:
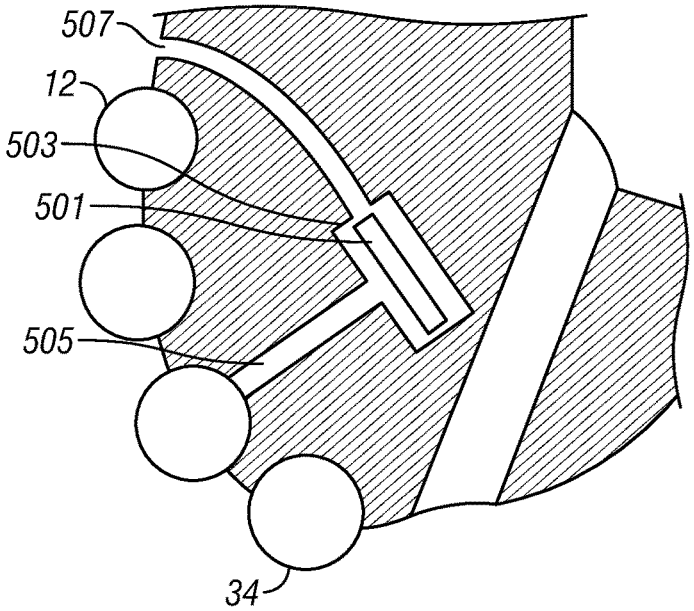
FIGS. 5A-5F show various arrangements for disposition of the sensor.

Referring to FIG. 5A, shown therein is a bit body 12 with cutters 34. A sensor 501 is shown disposed in a cavity 503 in the bit body 12. A communication (inflow) channel 505 is provided for flow of fluids and/or particles to the sensor 501. The cavity 503 is also provided with an outlet channel 507. The sensor 501 is similar to the sensor shown in FIG. 2 but lacks the cutting elements 213 but includes the circuit layer 215, and the sensor layer 217. The sensor 501 may include a chemical analysis sensor, an inertial sensor; an electrical potential sensor; a magnetic flux sensor and/or an acoustic sensor. The sensor 501 is configured to make a measurement of a property of the fluid conveyed to the cavity and/or solid material in the fluid.

Figure 5B:
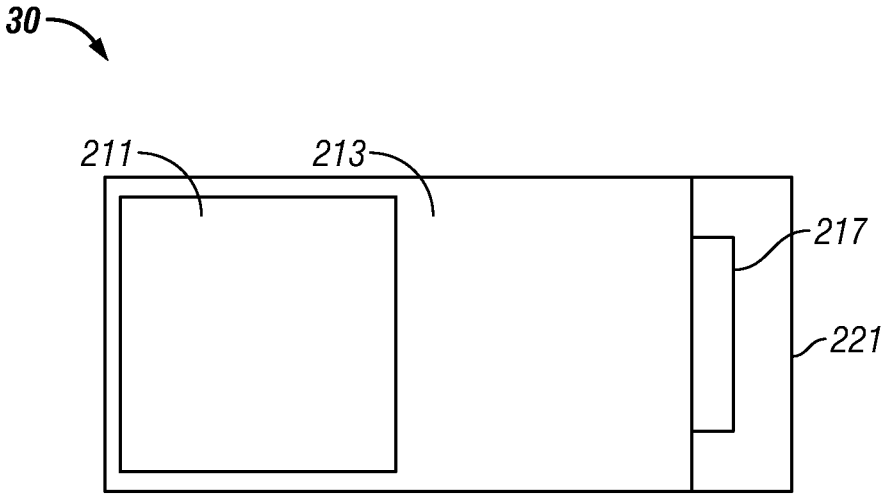
Figure 5C:
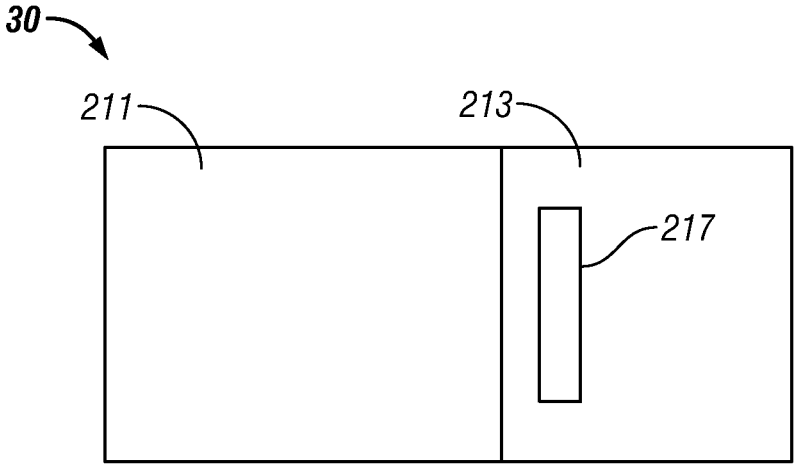
Figure 5D:
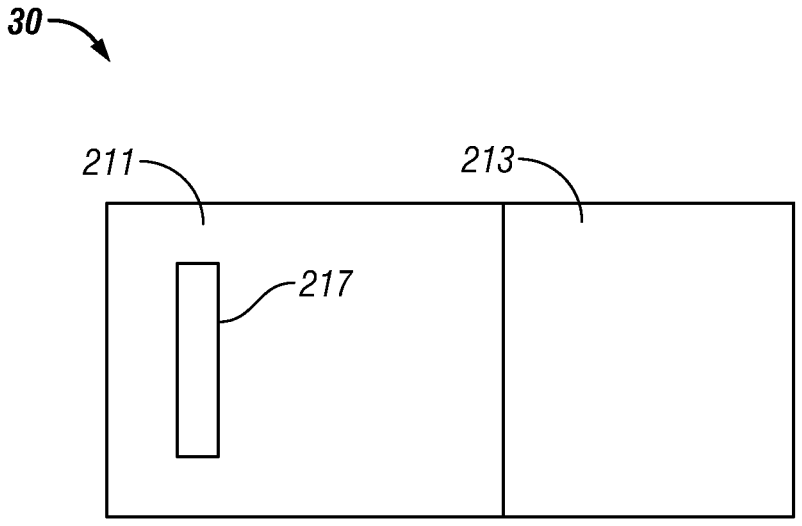
Figure 5E:
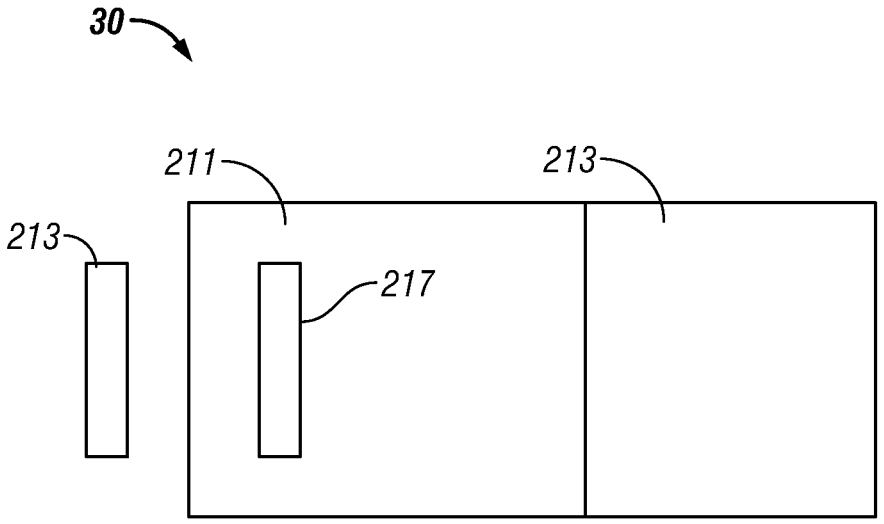
Figure 5F:
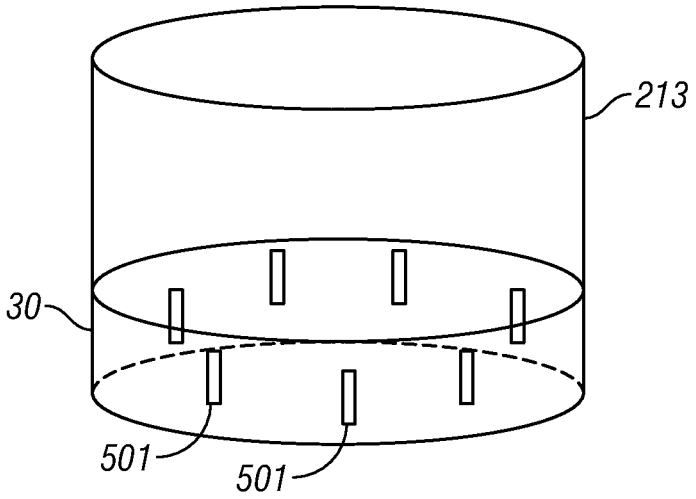

FIG. 5B shows the arrangement of the sensor 217 discussed in FIG. 2. In FIG. 5C, the sensor 217 is in the cutting element 213. FIG. 5D shows the sensor 217 in the substrate 211 and FIG. 5E shows one sensor 213 in the matrix 30 and one sensor 217 in the substrate 211. FIG. 5F shows an arrangement in which nanotube sensors 501 are embedded in the matrix. The nanotube sensors 501 may be used to measure pressure force and/or temperature.

Figure 6:
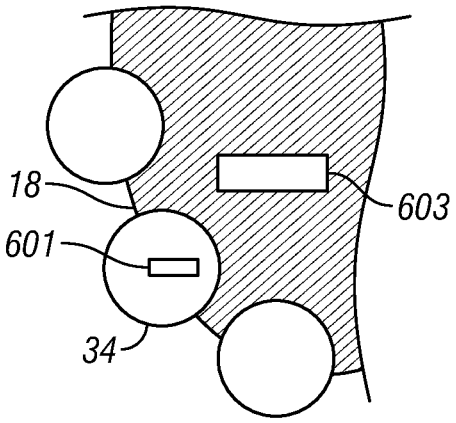
FIG. 6 illustrates an antenna on a surface of a PDC cutter.

FIG. 6 shows an antenna 601 on the cutter 34. An electromagnetic (EM) transceiver 603 is located in the matrix of the bit body 12. The transceiver 603 is used to interrogate the antenna 601 and retrieve data on the measurements made by the sensor 219 in FIG. 2. The transceiver 603 is provided with electrically shielded cables to enable communication with devices in the bit shank or a sub attached to the drill bit.

Figure 7A:
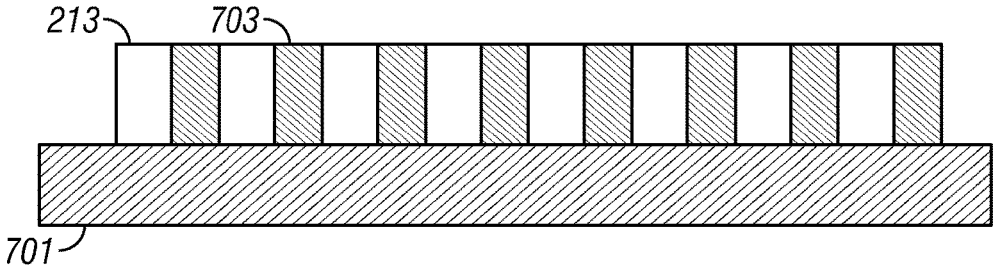
FIGS. 7A-7E illustrate the sequence in which different layers of the PDC cutter are made.

Referring to FIGS. 7A-7E, the sequence of operations used to assemble the PDC cutter 34 shown in FIG. 2 are discussed. As shown in FIG. 7A, PDC cutting elements 213 are mounted on a handle wafer 701 to form a diamond table. Filler material 703 is added to make the upper surface of the subassembly shown in FIG. 7A planar.

Figure 7B:
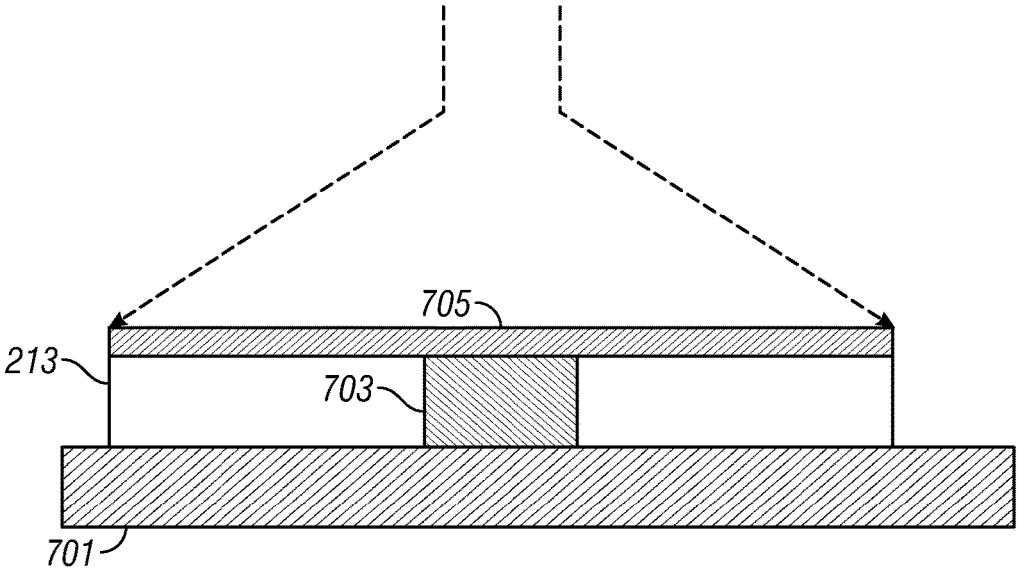

As shown in a detail of FIG. 7A, in FIG. 7B a "passivation layer" 705 comprising $Si_3N_4$ may be deposited on top of the PDC cutting elements 213 and the filler material 703. The purpose of the thin layer 705 is to improve adhesion between the cutting elements 213 and the layer above (discussed with reference to FIG. 7A). As suggested by the term "passivation," this layer 705 also prevents damage to the layer above by the PDC cutting element 213. Chemical-mechanical polishing (CMP) may be needed for forming the passivation layer 705. It should be noted that the use of $Si_3N_4$ is for exemplary purposes and not to be construed as a limitation. Equipment for chemical vapor deposition (CVD), Physical/Plasma Vapor Deposition (PVD), low pressure chemical vapor deposition (LPCVD), atomic layer deposition (ALD), and sol-gel spinning may be needed at this stage.

Figure 7C:
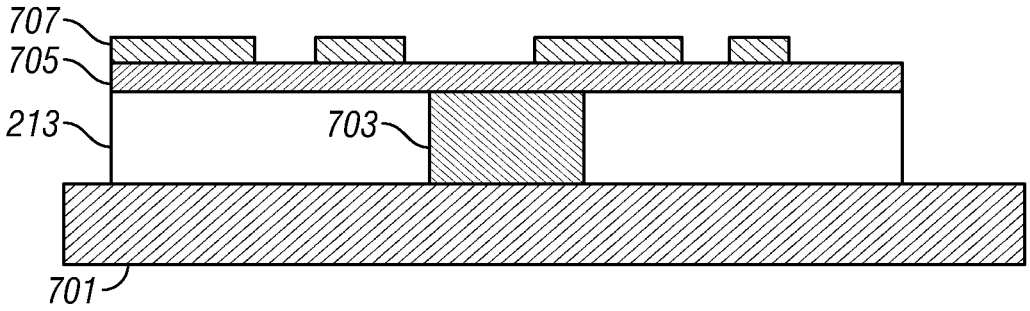
Figure 7D:
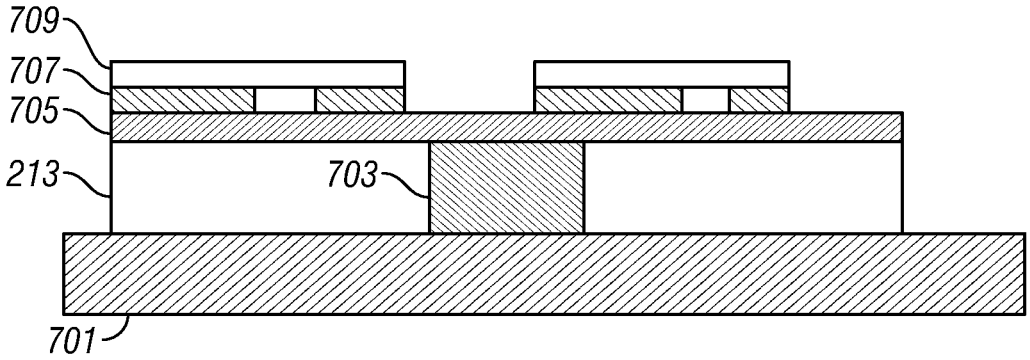

Referring next to FIG. 7C, metal traces and a pattern 709 for contacts and electronic circuitry are deposited. Equipment for sputter coating, evaporation, ALD, electroplating, and etching (plasma and wet) may be used. As shown in FIG. 7D, a piezoelectric material and a p-n-p semiconductor layer 709 are deposited. The output of the piezoelectric material may be used as an indication of strain when the underlying pattern on layer 707 includes a Wheatstone bridge. It should be noted that the use of a piezoelectric material is for exemplary purposes only and other types of sensor materials could be used. Equipment needed for this may include LPCVD, CVD, plasma, ALD and RF sputtering.

Figure 7E:
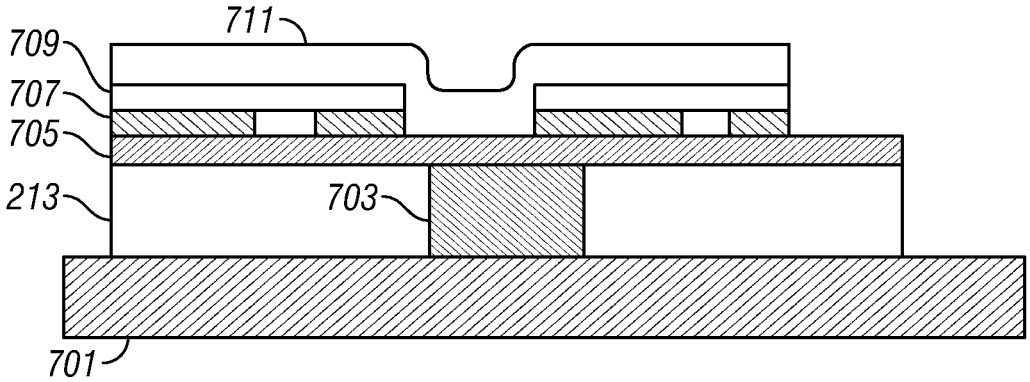

A protective passivation layer 711 that is conformal is added, as shown in FIG. 7E. The term "conformal" is used to mean the ability to form a layer over a layer of varying topology. This could be made of diamond-like carbon (DLC). Process equipment needed may include CVD, sintering, and RF sputtering. Removal of the handle 701 and the filler material 703 gives the PDC cutter 34 shown in FIG. 2 that may be attached to the wings 30 shown in FIG. 1.

Figure 8A:
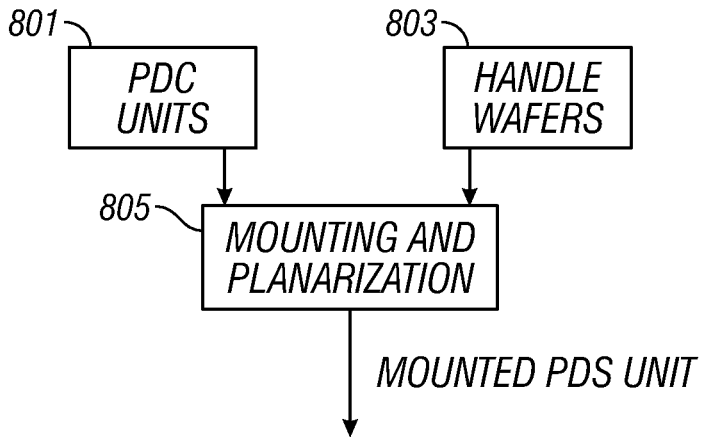
FIGS. 8A and 8B show the major operations needed to carry out the layering of FIGS. 7A-7E.
Figure 8B:
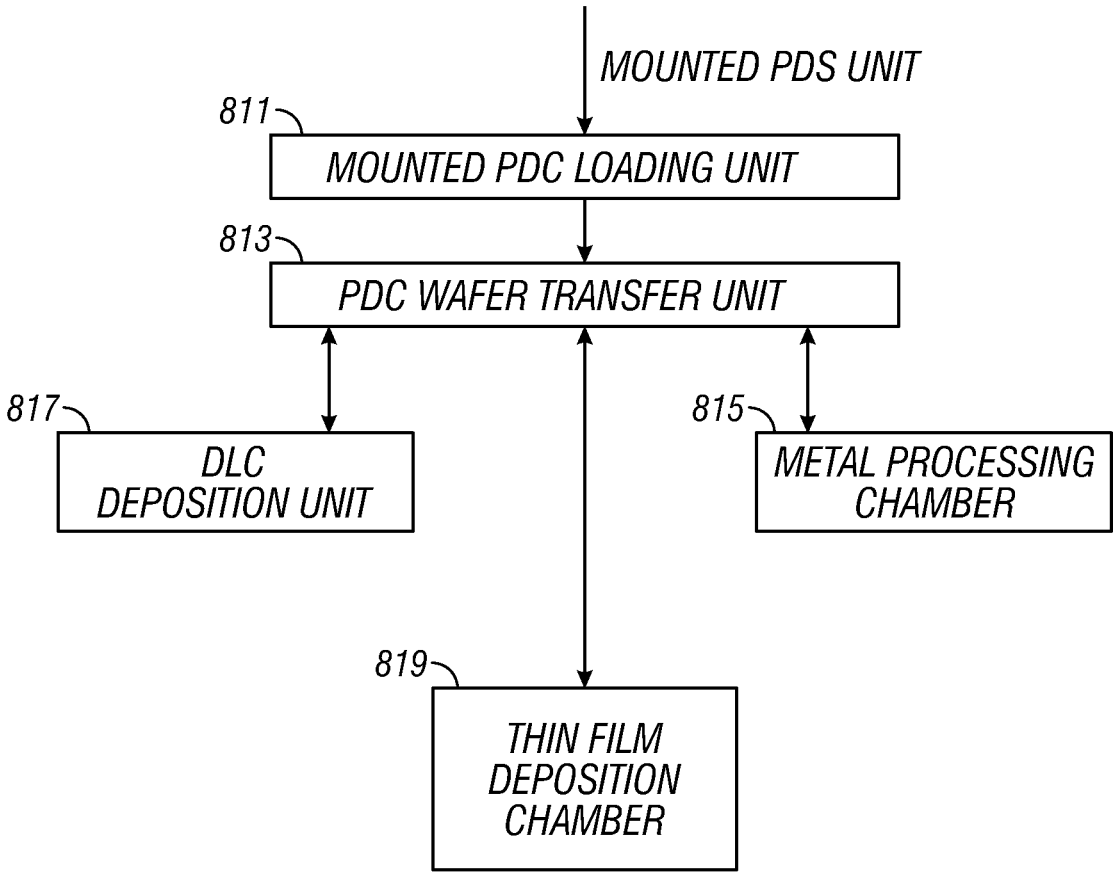

FIG. 8A shows the major operational units needed to provide the mounted PDC unit of FIG. 7B. This includes starting with the PDC cutting elements 213 in step 801 and the handle wafer 701 in step 803 to give a mounted and planarized unit 805.

The mounted PDC unit is transferred to a PDC loading unit 811 and goes to a PDC wafer transfer unit 813. The units are then transferred to the units or chambers identified as 815, 817 and 819. The metal processing chamber 815 which may include CVD, sputtering and evaporation. The thin-film deposition chamber 819 may include LPCVD, CVD, and plasma enhanced CVD. The DLC deposition chamber 817 may include CVD and ALD. Next, the fabrication of the array of FIG. 3 is discussed.

Figure 9:
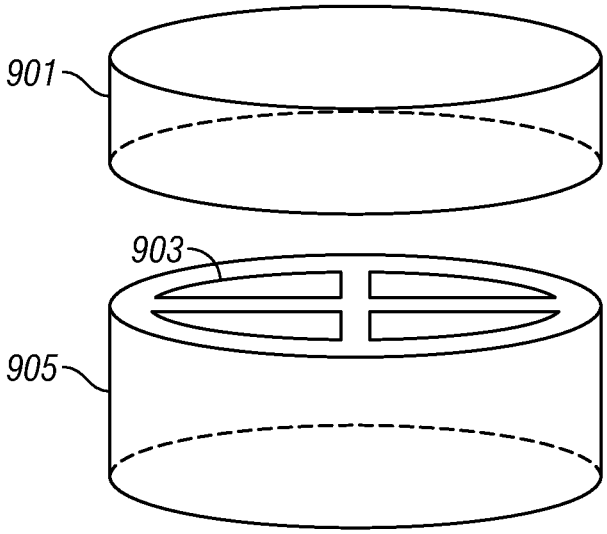
FIG. 9 shows the basic structure of a pad including sensors of FIG. 3.

Referring now to FIG. 9, a tungsten carbide substrate base 905 is shown with sensors 903 and a PDC table. One method of fabrication comprises deposition of the sensing layer 903 directly on top of the tungsten carbide base 905 and then forming a diamond table 901 on top of the tungsten carbide substrate base 905. Temperatures of 1500° C. to 1700° C. may be used and pressures of around $10^6$ psi may be used.

Figure 10A:
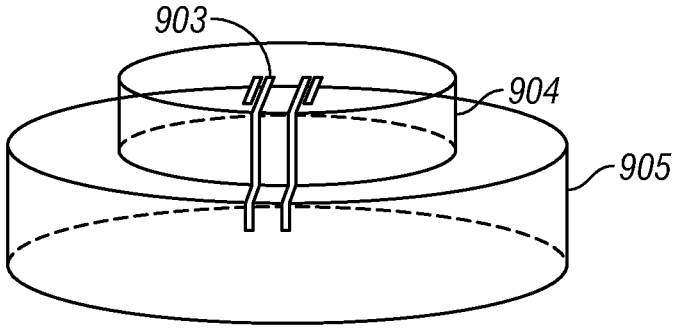
FIGS. 10A and 10B show steps in the fabrication of the assembly of FIG. 3.
Figure 10B:
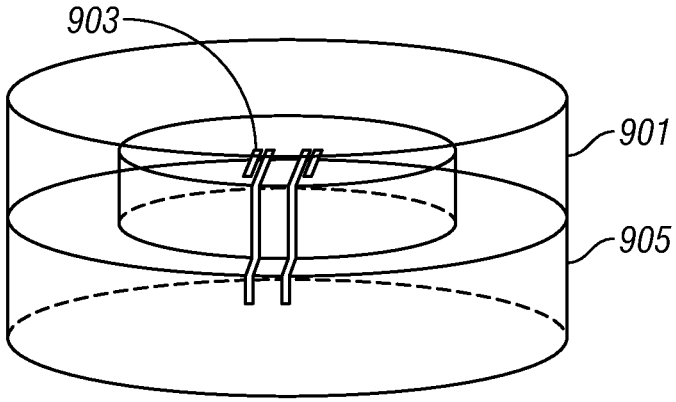

Such an assembly can be fabricated by building a sensing layer 903 on the substrate 905 and running traces 904 as shown in FIG. 10A. The diamond table 901 is next deposited on the substrate. Alternatively, the diamond table 901 may be preformed, based on the substrate 905, and brazed.

Figure 11A:
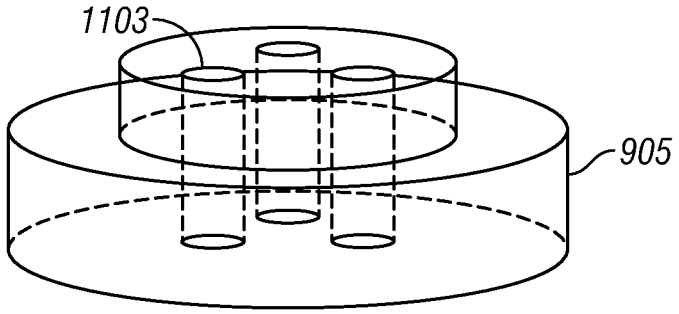
FIGS. 11A and 11B show steps in the fabrication of the assembly of FIG. 5F.
Figure 11B:
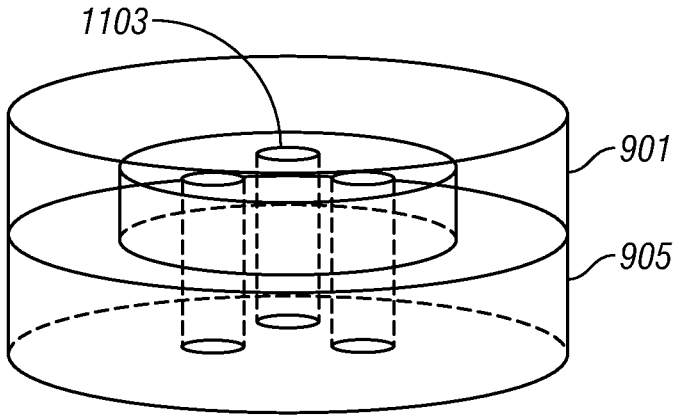

Fabrication of the assembly shown in FIG. 5F is discussed next with reference to FIGS. 11A and 11B. The nanotubes 1103 are inserted into the substrate 905. The diamond table 901 is next deposited on the substrate 905.

Integrating temperature sensors in the assemblies of FIGS. 10A-11B is relatively straightforward. Possible materials to be used are high-temperature thermocouple materials. Connection may be provided through the side of the PDC or through the bottom of the PDC.

Pressure sensors made of quartz crystals can be embedded in the substrate. Piezoelectric materials may be used. Resistivity and capacitive measurements can be performed through the diamond table by placing electrodes on the tungsten carbide substrate. Magnetic sensors can be integrated for failure magnetic surveys. Those versed in the art and having benefit of the present disclosure would recognize that magnetic material would have to be re-magnetized after integrating into the sensor assembly. Chemical sensors may also be used in the configuration of FIGS. 11A and 11B. Specifically, a small source of radioactive materials is used in or instead of one of the nanotubes and a gamma ray sensor or a neutron sensor may be used in the position of another one of the nanotubes.

Figure 12:
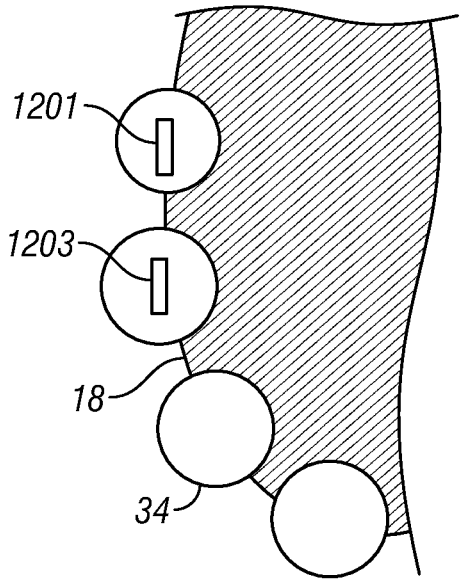
FIG. 12 illustrates the use of transducers on two different cutting elements for measurement of acoustic properties of the formation.

Those versed in the art and having benefit of the present disclosure would recognize that the piezoelectric transducer could also be used to generate acoustic vibrations. Such ultrasonic transducers may be used to keep the face of the PDC element clean and to increase the drilling efficiency. Such a transducer may be referred to as a vibrator. In addition, the ability to generate elastic waves in the formation can provide much useful information. This is schematically illustrated in FIG. 12 that shows acoustic transducers on two different PDC cutters 34. One of them, for example, transducer 1201 may be used to generate a shear wave in the formation. The shear wave propagating through the formation is detected by the transducer 1203 at a known distance from the source transducer 1201. By measuring the travel time for the shear wave to propagate through the formation, the formation shear velocity can be estimated. This is a good diagnostic of the rock type. Measurement of the decay of the shear wave over a plurality of distances provides an additional indication of the rock type. In one embodiment of the disclosure, compressional wave velocity measurements are also made. The ratio of compressional wave velocity to shear wave velocity ($V_P/V_s$ ratio) helps distinguish between carbonate rocks and siliciclastic rocks. The presence of gas can also be detected using measurements of the $V_P/V_s$ ratio. In an alternative embodiment, the condition of the cutting element may be determined from the propagation velocity of surface waves on the cutting element. This is an example of determination of the operating condition of the drill bit.

The shear waves may be generated using an electromagnetic acoustic transducer (EMAT). U.S. Pat. No. 7,697,375 to Reiderman et al., having the same as in the as the present disclosure and the contents of which are incorporated herein by reference discloses a combined EMAT adapted to generate both SH and Lamb waves. Teachings such as those of Reiderman may be used in the present disclosure.

The acquisition and processing of measurements made by the transducer may be controlled at least in part by downhole electronics (not shown). Implicit in the control and processing of the data is the use of a computer program on a suitable machine readable-medium that enables the processors to perform the control and processing. The machine-readable medium may include ROMs, EPROMs, EEPROMs, Flash memories and optical discs. The term processor is intended to include devices such as a field programmable gate array (FPGA).

What is claimed is:

1. An earth-boring rotary drill bit, comprising:

at least one polycrystalline diamond compact (PDC) cutter including:

a base substrate; and a diamond table coupled with the base substrate;

a bit body coupled with the PDC cutter; and at least a portion of a transducer located within a cavity of the bit body, wherein the bit body includes at least one outflow channel and at least one inflow channel to allow flow of a fluid into the bit body to contact the at least one transducer and flow out of the bit body, and the at least one transducer is configured to measure a property of at least one of the fluid or a solid material within the fluid.

2. The rotary drill bit of claim 1, wherein the transducer is selected from the group consisting of a piezoelectric transducer, an ultrasonic transducer, an accelerometer, a gyroscope, an inclinometer, a micro-electro-mechanical system, and a nano-electro-mechanical system.

3. The rotary drill bit of claim 1, wherein the transducer is selected from the group consisting of a pressure sensor, a magnetic sensor, and a chemical sensor.

4. An earth-boring rotary drill bit, comprising:

a bit body;

a cutting element coupled with the bit body, the cutting element comprising:

a base substrate; and a diamond table disposed on the base substrate; and at least one transducer disposed in a cavity within the bit body, wherein the bit body includes at least one outflow channel and at least one inflow channel to allow flow of a fluid into the bit body to contact the at least one transducer and flow of the fluid out of the bit body, and the at least one transducer is configured to measure a property of at least one of the fluid or a solid material within the fluid.

5. The rotary drill bit of claim 4, wherein the at least one transducer includes a sensor selected from the group consisting of a chemical analysis sensor, an inertial sensor, an electrical potential sensor, a magnetic flux sensor, and an acoustic sensor.

6. The rotary drill bit of claim 4, wherein the at least one transducer includes a circuit layer and a sensor layer.

7. The rotary drill bit of claim 6, wherein the circuit layer includes metal traces coupled with the sensor layer.

8. The rotary drill bit of claim 7, wherein the sensor layer includes at least one sensor configured for elemental analysis of the fluid or the solid material.

9. The rotary drill bit of claim 8, wherein the at least one sensor includes at least one carbon nanotube (CNT).

10. The rotary drill bit of claim 8, wherein the at least one sensor includes a complementary metal oxide semiconductor (CMOS) sensor configured to detect a presence of trace elements based, at least in part, on a selectively gated field effect transistor (FET) or ion sensitive field effect transistor (ISFET) for detecting pH or $H_2S$.

11. The rotary drill bit of claim 8, wherein the at least one sensor is configured for hydrocarbon analysis.

12. The rotary drill bit of claim 8, wherein the at least one sensor includes at least one carbon nanotube or carbon-based sensor that is configured for detecting chemical electropotential.

13. The rotary drill bit of claim 8, wherein the at least one sensor is configured for carbon and/or oxygen analysis.

14. The rotary drill bit of claim 7, wherein the sensor layer includes a sensor that generates an electric signal responsive to radiation.

15. The rotary drill bit of claim 14, wherein the at least one transducer includes at least one of a gamma ray sensor or a neutron sensor.

16. The rotary drill bit of claim 7, wherein the sensor layer includes a sensor that generates an electric signal responsive to mechanical motion.

17. The rotary drill bit of claim 4, wherein the at least one transducer is configured to measure a property of both of the fluid and the solid material within the fluid.

* * * * *